US007218285B2

(12) United States Patent
Davis et al.

(10) Patent No.: US 7,218,285 B2
(45) Date of Patent: May 15, 2007

(54) METAMATERIAL SCANNING LENS ANTENNA SYSTEMS AND METHODS

(75) Inventors: Mark R. Davis, Bellevue, WA (US); Robert B. Greegor, Auburn, WA (US); Kin Li, Bellevue, WA (US); Jean A. Nielsen, Kent, WA (US); Claudio G. Parazzoli, Seattle, WA (US); Minas H. Tanielian, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/913,109

(22) Filed: Aug. 5, 2004

(65) Prior Publication Data

US 2006/0028385 A1 Feb. 9, 2006

(51) Int. Cl.
*H01Q 19/06* (2006.01)

(52) U.S. Cl. ..... 343/754; 343/753

(58) Field of Classification Search ..... 343/753, 343/754, 909, 911 R
See application file for complete search history.

(56) References Cited

U.S. PATENT DOCUMENTS

| | | | | |
|---|---|---|---|---|
| 6,859,114 | B2 * | 2/2005 | Eleftheriades et al. | 333/156 |
| 2003/0155919 | A1 | 8/2003 | Pendry et al. | |
| 2004/0066251 | A1 * | 4/2004 | Eleftheriades et al. | 333/117 |
| 2004/0227687 | A1 * | 11/2004 | Delgado et al. | 343/872 |

OTHER PUBLICATIONS

R. Colin Johnson, 'Metamaterial' holds promise for antennas, optics, EDTN Network, May 11, 2001, 4 pgs. United Business Media, San Diego, CA.

C.G. Parazoli et al., Experimental Verification and Simulation of Negative Index of Refraction Using Snell's Law, Mar. 11, 2003, 4 pgs., Phys. Rev. Lett. 90 No. 10, 107401.

J.B. Pendry, Negative Refraction Makes a Perfect Lens, Oct. 30, 2000, 4 pgs., Phys. Rev. Lett. 85 No. 18, 3966.

Physicsweb, Electromagnetic materials enter the negative age, Sep. 2001, Physics World, IOP Publishing Ltd 2001.

R. Colin Johnson, Unnatural optics create precise photonic lens, Aug. 27, 2002, 2 pgs., EE Times, CMP Media, LLC 2003.

APS News Online, "Left-Handed" Materials Could Make Perfect Lenses, May 2004, 3 pgs., APS 2003.

A. Houck, Experimental Observations of a left-Handed Material That Obeys Snell's Law, Apr. 4, 2003, 4 pgs., Phys. Rev. Lett. 90 No. 13, 137401.

David Smith, USDC—Left-Handed Metamaterials, May 2003, 5 pgs., Arlington, VA.

R. Colin Johnson, "Metamaterial" holds promise for antennas, optics, May 11, 2001, 2 pgs. EE Times, CMP Media, LLC 2003.

D. R. Smith et al., Negative Refractive Index in Left-Handed Materials, Oct. 2, 2000, Phys. Rev. Lett 85 No. 14, 2933.

Kim McDonald, Left-Handed Material Has Negative Index of Refraction, Apr. 6, 2001, 3 pgs., Daily University Science News, Oct. 23, 2003.

* cited by examiner

*Primary Examiner*—Tho Phan
(74) *Attorney, Agent, or Firm*—Lee & Hayes, PLLC

(57) ABSTRACT

The present invention is directed to systems and methods for radiating radar signals, communication signals, or other similar signals. In one embodiment, a system includes a controller that generates a control signal and an antenna coupled to the controller. The antenna includes a first component that generates at least one wave based on the generated control signal and a metamaterial lens positioned at some predefined focal length from the first component. The metamaterial lens directs the generated at least one wave.

24 Claims, 5 Drawing Sheets

METAMATERIAL SCANNING LENS ANTENNA SYSTEMS AND METHODS

GOVERNMENT LICENSE RIGHTS

This invention was made with Government support under a U.S. government contract number: MDA972-01-2-0016. The Government has certain rights in this invention.

FIELD OF THE INVENTION

This invention relates to antennas, and, more particularly to more efficient and compact scanning lens antennas.

BACKGROUND OF THE INVENTION

High and medium gain antennas that can be scanned or can produce multiple simultaneous beams are needed for a variety of mobile communications and sensor applications. Typically, the mechanical or electronic systems required to scan the antenna or produce multiple beams are bulky, complex, and expensive.

Conventional scanning lens antennas use a dielectric lens to collimate the spherical wave from a small (low gain) radiator into a narrow beam (higher gain) plane wave. Shifting the location of the feed point of the radiator will scan the antenna beam over limited range of angles. Pattern quality is a function of the focal distance. A thin lens with a long focal length minimizes pattern distortions but will lose power due to spill over and will require a large rigid structure to support the lens and radiator. Shortening the focal distance requires a more complex series of lenses or results in spherical aberrations.

Therefore, there exists a need for a lens antenna that does not exhibit spherical aberrations, has minimal focal length and has a low level of complexity, thereby being cheaper to produce and implement.

SUMMARY OF THE INVENTION

The present invention is directed to systems and methods for radiating radar signals, communication signals, or other similar signals. In one embodiment, a system includes a controller that generates a control signal and an antenna coupled to the controller. The antenna includes a first component that generates at least one wave based on the generated control signal, and a metamaterial lens positioned at some predefined focal length from the first component. Metamaterial is a material that exhibits a negative index of refraction. A metamaterial with a negative index of refraction of n=−1 has the focusing power of an equivalent dielectric lens with n=3, based on the lensmaker equation, $$f = \frac{1}{|n-1|}$$

The metamaterial lens directs at least one generated wave. Because the present invention uses a metamaterial lens with much larger focusing power, an antenna can be formed having a relatively small focal length, thereby allowing the antenna to be produced in a smaller overall package than conventional scanning lens antennas without requiring the additional complexity or exhibiting the usual amount of spherical aberrations.

In accordance with further aspects of the invention, the system includes a user interface that is coupled to the controller. The user interface component allows a user to generate an instruction signal that the controller uses to generate the control signal.

In accordance with other aspects of the invention, the antenna further includes a sensor that senses waves received by the metamaterial lens. The sensor is coupled to the controller. The sensor may be a data storage device or an output device, such as a display.

In accordance with still further aspects of the invention, the antenna includes one or more actuators that receives at least a portion of the control signal from the controller and positions the first component or the metamaterial lens based on the received portion of the control signal.

In accordance with yet other aspects of the invention, the metamaterial lens includes a convex, concave, or gradient index lens.

BRIEF DESCRIPTION OF THE DRAWINGS

The preferred and alternative embodiments of the present invention are described in detail below with reference to the following drawings.

DETAILED DESCRIPTION OF THE INVENTION

The present invention relates to antennas, and more specifically, to systems and methods for radiating radar signals, communication signals, or other similar signals. Many specific details of certain embodiments of the invention are set forth in the following description and in FIGS. 1–7 to provide a thorough understanding of such embodiments. One skilled in the art, however, will understand that the present invention may have additional embodiments, or that the present invention may be practiced without several of the details described in the following description.

Figure 1:
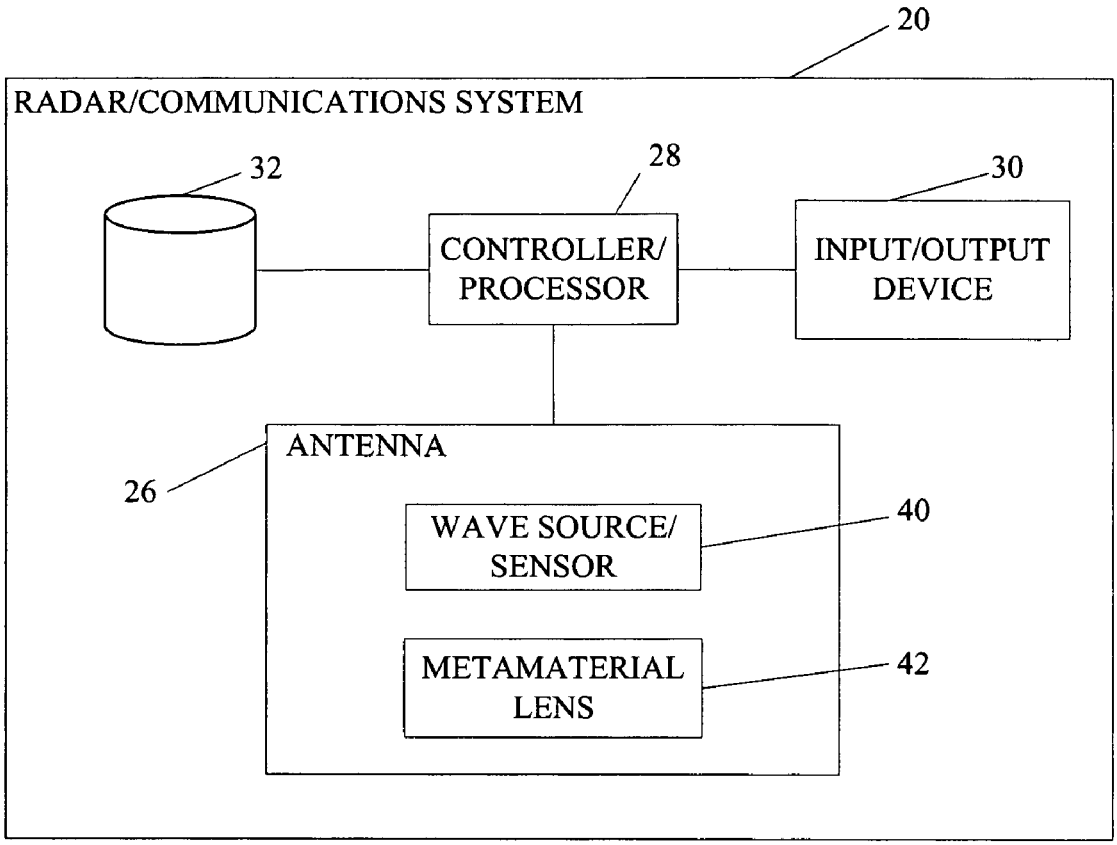
FIG. 1 illustrates a block diagram of an exemplary system formed in accordance with an embodiment of the present invention.

FIG. 1 illustrates a radar or communication system 20 for performing transmission and reception of signals. The system 20 includes an antenna 26, a controller/processor 28, an input/output device 30, and a storage unit 32. The controller processor 28 is operatively coupled to the antenna 26, the input/output device 30, and the storage unit 32.

The controller processor 28 may be a radar or communications processor that converts signals for output by the antenna 26 as radar waves/communication signals or converts radar waves/communication signals received by the antenna 26 into data for output through the input/output device 30.

Examples of the input/output device 30 include user interface devices such as mouse, keyboard, microphone, or any comparable control or data input device. Also, the input/output device 30 may include a display device, speakers, or other comparable device that outputs radar or communication data converted by the controller/processor 28.

As further shown in FIG. 1, the antenna 26 includes a wave source/sensor 40 and a metamaterial lens 42. The metamaterial lens 42 provides a focal length much smaller than that of traditional lenses. Thus, the wave source/sensor 40 is located closer to the lens 42 than in a conventional system, thereby allowing the antenna 26 to be packaged into a smaller unit than a traditional scanning antenna. Examples of metamaterial lenses 42 are described below with respect to FIGS. 2–4.

The term "metamaterial" is defined as negative-index-of-refraction materials. To produce a meta-material device a substrate material is provided and an array of electromagnetically reactive patterns of a conductive material are applied to a surface of the substrate material. Two of the substrate materials are joined together such that the surfaces bearing the electromagnetically reactive pattern are commonly oriented to form a substrate block. Each substrate block is sliced between elements of the array of electromagnetically reactive patterns in a plane perpendicular to a surface to which the electromagnetically reactive patterns were applied. An array of electromagnetically reactive patterns of a conductive material are applied to each surface of the substrate block. This is described in more detail in co-pending, commonly-owned U.S. patent application Ser. No. 10/356,934 filed Jan. 31, 2003, which is hereby incorporated by reference.

Figure 2:
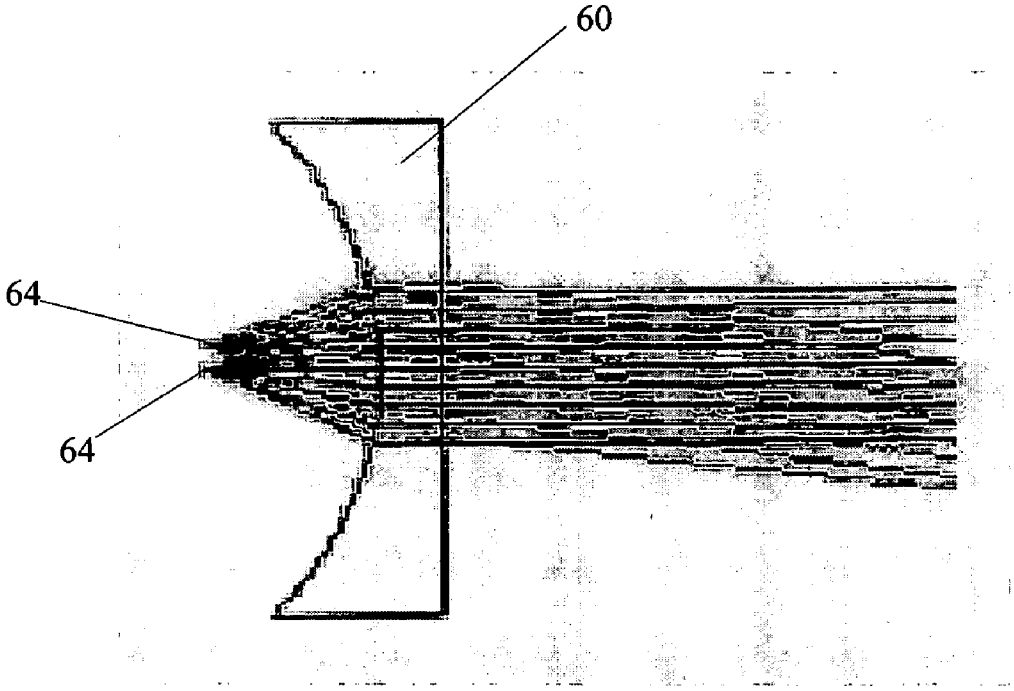
FIGS. 2–4 illustrate side views of exemplary metamaterial lenses used as scanning antenna formed in accordance with embodiments of the present invention.
Figure 3:
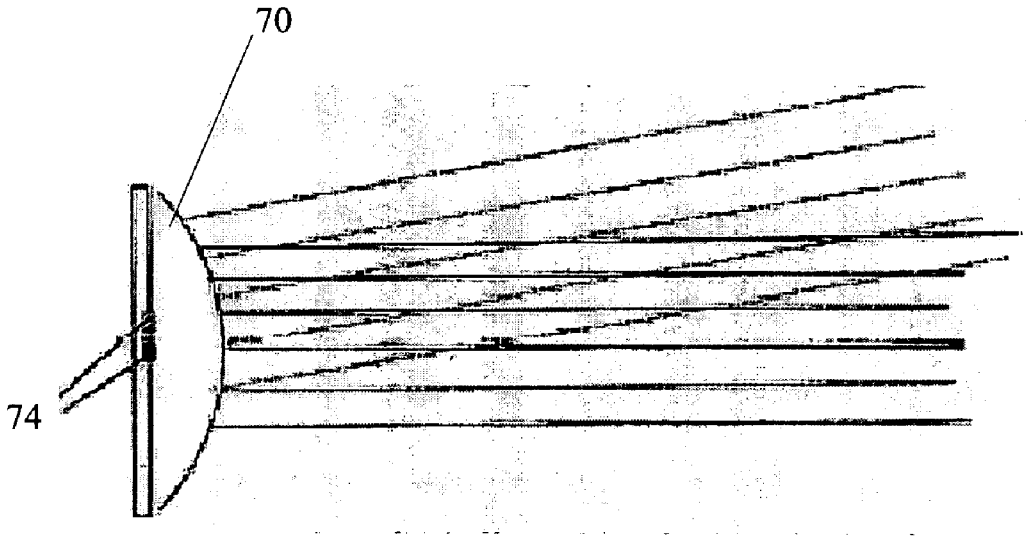

Referring to FIG. 2, a concave lens 60 formed of metamaterial is used as a collimating lens of waves produced by a wave source at points 64. Similarly, FIG. 3 illustrates a convex lens 70 formed with metamaterial for collimating waves produced at source points 74. The metamaterial used in the lenses 60 and 70 has a negative index of refraction and responds to electromagnetic fields in a left-handed manner (i.e., negative permittivity and permeability), as described more fully in the above-referenced patent application.

Figure 4A:
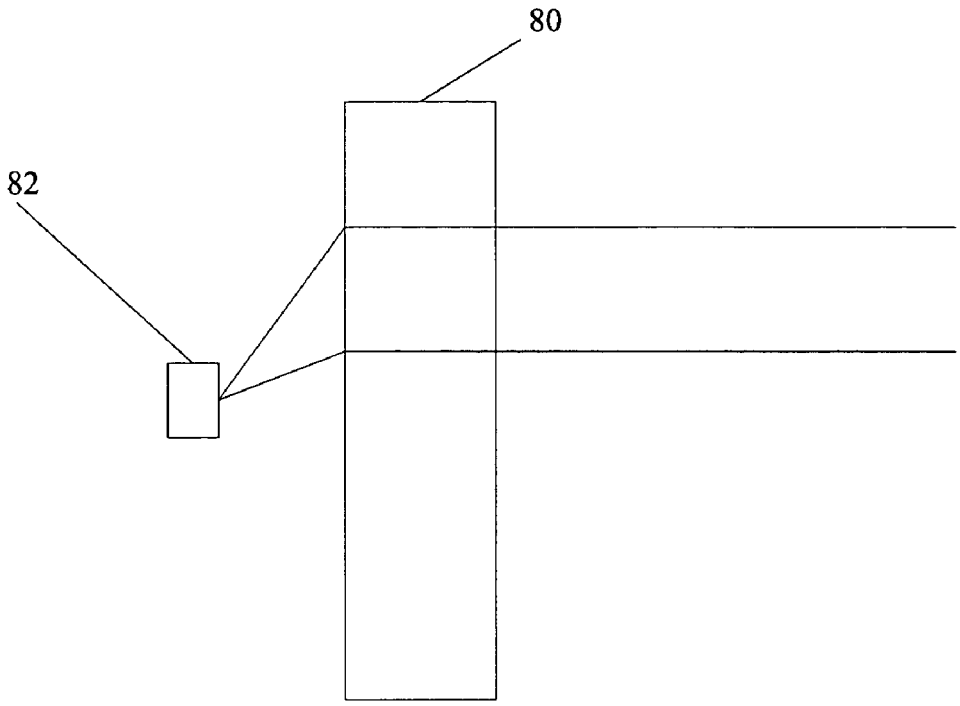
Figure 4B:
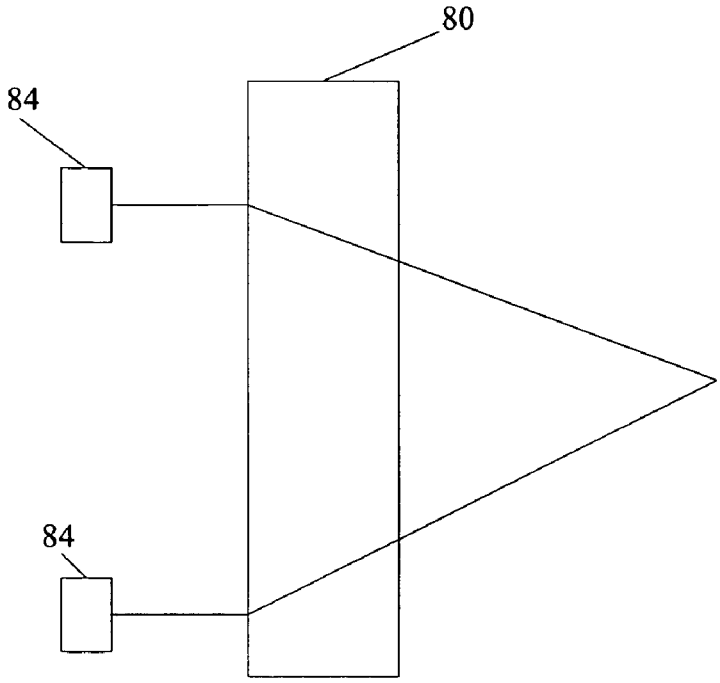

FIGS. 4A and 4B illustrate a thin slab lens 80 formed of a metamaterial to act as a gradient index lens, such as a Fresnel lens. In other words, the index of refraction varies away from the center point of the lens 80. Thus, the lens 80 can act like a convex or concave lens at much less thickness. As shown in FIG. 4A, the lens 80 acts as a collimator of waves produced by a source 82. As shown in FIG. 4B, the lens 80 acts as a collector of waves produced by sources 84.

Figure 5:
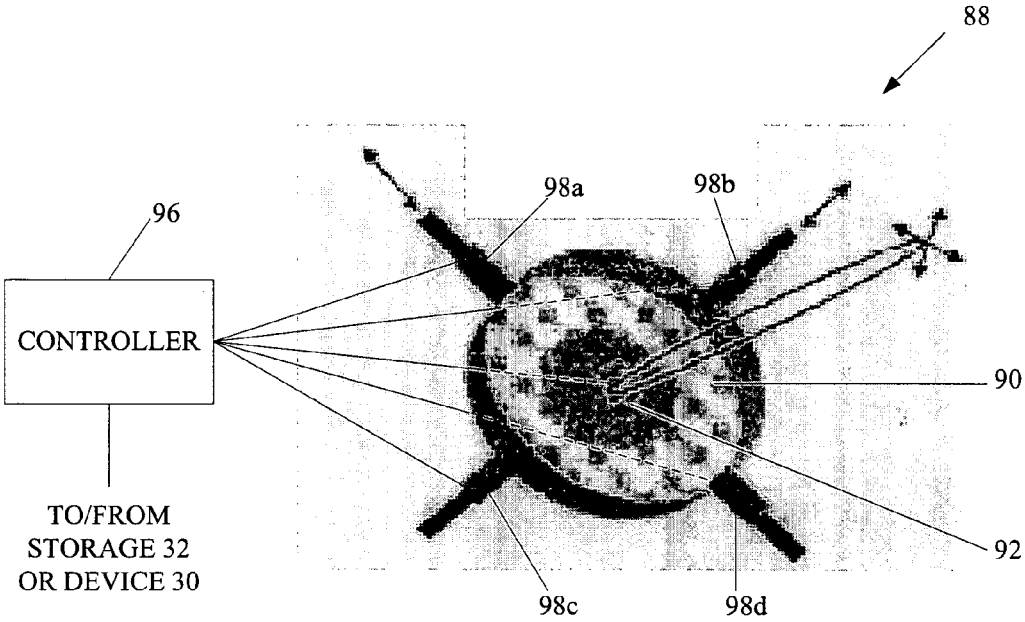
FIGS. 5–7 illustrate portions of exemplary systems for using the lenses of FIGS. 2–4 in a scanning lens antenna scenario.

Referring now to FIG. 5, a first example system 88 is shown. A system 88 includes a metamaterial lens 90, a wave source/sensor 92, actuators 98A–D, and a controller 96. The actuators 98A–D provide support and movement of the wave source/sensor 92, and are controlled by signals from the controller 96. The controller 96 also sends information to and from the storage unit 32 or the input/output device 30 (FIG. 1).

Figure 6:
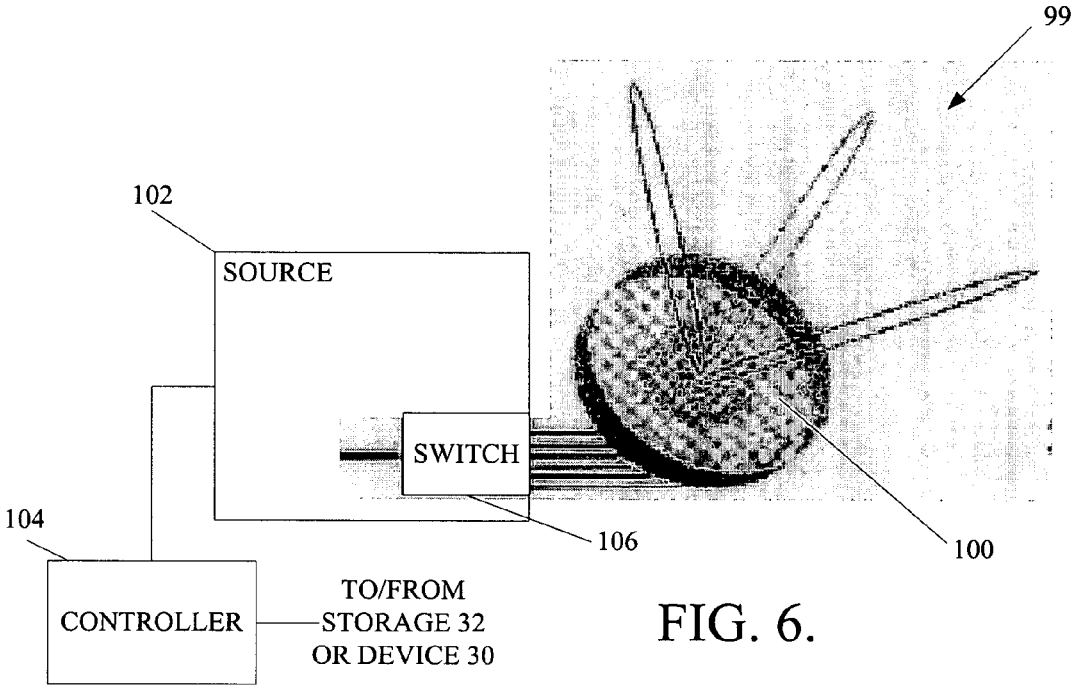

FIG. 6 illustrates another embodiment of the present invention. In this embodiment, a system 99 includes a metamaterial lens 100 that directs signals produced by a source 102 as controlled by a controller 104. The source 102 includes a switch 106. The switch 106 is coupled to a plurality of feeds points at a predefined focal length from the lens 100. The switch 106 receives instructions from the controller 104 and directs the generated wave to a desired feed point based on the instructions. In other words, the feed points are separately addressable by the switch 106. Examples could be a array of PIN diodes patch antennas, dipoles, transmission lines, etc.

Figure 7:
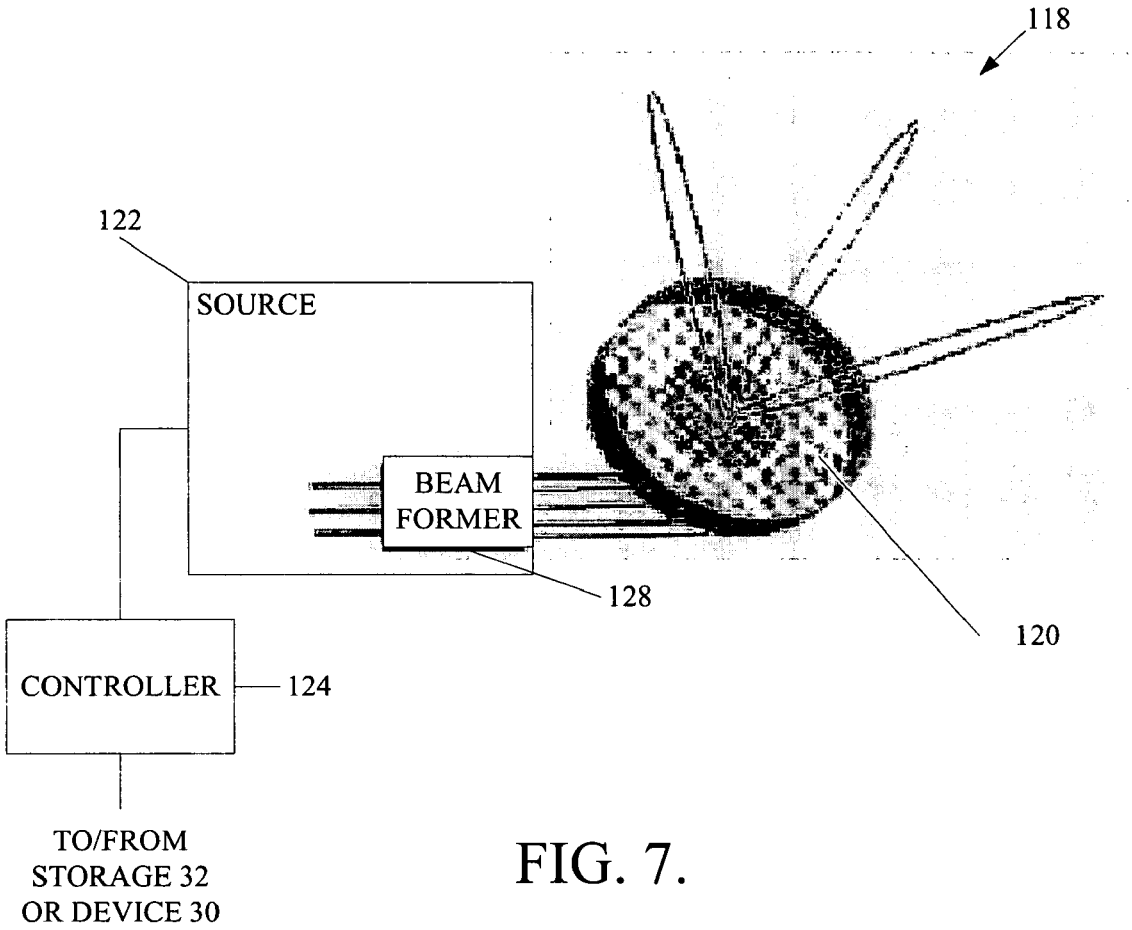

FIG. 7 illustrates another embodiment of the present invention. As shown in FIG. 7, a system 118 includes a metamaterial lens 120 that redirects a plurality of output waves produced by the source 122 as directed by the controller 124. The source 122 includes a beam former 128 that simultaneously sends a plurality of wave forms to various feed points at a predefined focal length behind the lens 120. In this embodiment, the system 118 is not a scanning antenna, but rather, may be any other suitable type of signal transmission and receiver system, including, for example, a set of PIN diodes that are on the ON state simultaneously thus enabling a multi-beam communication system.

The lenses 90, 100, and 120 maybe any of the metamaterial lenses shown in FIGS. 2–4 or any variation or combination of metamaterial based lenses.

Embodiments of systems and methods in accordance with the present invention may provide significant advantages over the prior art. For example, because systems in accordance with the present invention use a metamaterial lens, an antenna may be formed having a relatively small focal length in comparison with prior art systems. Thus, the antenna may be produced in a smaller overall package than conventional scanning lens antennas without requiring the additional complexity or exhibiting the usual amount of spherical aberrations. The resulting systems and methods may further have a low level of complexity, thereby being cheaper to produce and implement.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A system comprising:

a controller configured to generate a control signal; and an antenna coupled to the controller, the antenna including;

a first component configured to generate at least one wave based on the control signal; and a metamaterial lens positioned and configured to direct the at least one wave.

2. The system of claim 1, further comprising:

a user interface component coupled to the controller, the user interface component configured to allow a user to generate an instruction signal; and wherein the controller is further configured to generate the control signal based on the instruction signal.

3. The system of claim 1, wherein the antenna further includes:

a sensor configured to sense waves received by the metamaterial lens, the sensor being coupled to the controller.

4. The system of claim 3, further comprising:

a data storage device coupled to the controller and configured to store data received by the sensor via the controller.

5. The system of claim 3, further comprising:

an output device coupled to the controller and configured to output data received by the sensor.

6. The system of claim 5, wherein the output device is a display device.

7. The system of claim 1, wherein the antenna includes one or more actuators configured to receive at least a portion of the control signal from the controller and position at least one of the first component or the metamaterial lens based on the received portion of the control signal.

8. The system of claim 1, wherein the first component includes a plurality of wave source devices.

9. The system of claim 8, wherein the plurality of wave source devices are separately controllable by the controller.

10. The system of claim 8, wherein two or more of the plurality of wave source devices are configured to simultaneously transmit waves.

11. The system of claim 1, wherein the metamaterial lens is selected from a group consisting of a convex lens, a concave lens, and a gradient index lens.

12. An antenna system coupled to a controller that generates a control signal, the antenna system comprising:

a first component configured to generate at least one wave based on the control signal; and a metamaterial lens substantially at a focal length and positioned to receive the wave from the first component, the metamaterial lens being configured to direct the at least one wave.

13. The system of claim 12, further comprising:

a sensor configured to sense waves received by the metamaterial lens, wherein the sensor is coupled to the controller.

14. The system of claim 12, further comprising:

one or more actuators configured to receive at least a portion of the control signal from the controller and position at least one of the first component or the metamaterial lens based on the received portion of the control signal.

15. The system of claim 12, wherein the first component includes a plurality of wave source devices.

16. The system of claim 15, wherein the plurality of wave source devices are separately controllable by the controller.

17. The system of claim 15, wherein at least two of the plurality of wave source devices are configured to simultaneously transmit waves.

18. The system of claim 12, wherein the metamaterial lens is selected from a group consisting of a convex lens, a concave lens, and a gradient index lens.

19. A method comprising:

generating a control signal;

generating at least one wave based on the control signal;

sending the at least one wave through a metamaterial lens; and sensing at least one wave received by the metamaterial lens.

20. The method of claim 19, further comprising:

storing data associated with the sensed at least one wave.

21. The method of claim 19, further comprising:

outputting data associated with the sensed at least one wave.

22. The method of claim 21, wherein outputting includes displaying.

23. A method comprising:

generating a control signal;

generating at least one wave based on the control signal;

sending the at least one wave through a metamaterial lens; and scanning by positioning at least one of the first component or the metamaterial lens based on at least a portion of the control signal.

24. A method comprising:

generating a control signal;

generating at least one wave based on the control signal; and sending the at least one wave through a metamaterial lens, wherein the metamaterial lens is selected from a group consisting of a convex lens, a concave lens, and a gradient index lens.

* * * * *